US006378593B1

(12) United States Patent
Mullet et al.

(10) Patent No.: US 6,378,593 B1
(45) Date of Patent: Apr. 30, 2002

(54) ACCESS PANEL FOR OPERATING AN IN-WALL CURTAIN DRIVE SYSTEM AND METHOD OF USING SAME

(75) Inventors: Willis J. Mullet; James F. Baudanza, both of Gulf Breeze, FL (US)

(73) Assignee: Wayne-Dalton Corp., Mt. Hope, OH (US)

( * ) Notice: Subject to any disclaimer, the term of this patent is extended or adjusted under 35 U.S.C. 154(b) by 0 days.

(21) Appl. No.: 09/687,377

(22) Filed: Oct. 13, 2000

(51) Int. Cl.[7] ..... E05F 11/00
(52) U.S. Cl. ..... 160/193; 160/26
(58) Field of Search ..... 160/31, 26, 320, 160/321, 193; 52/202, 718.03, 718.04, 718.06, 718.07, 211; 49/447, 448, 254; 312/322, 319.2, 204; 292/87

(56) References Cited

U.S. PATENT DOCUMENTS 146,414 A * 1/1874 Voorhees
1,482,426 A * 2/1924 Aus
2,299,317 A * 10/1942 Fink
3,061,346 A * 10/1962 Jorgensen
3,961,659 A * 6/1976 Siegel
4,359,079 A * 11/1982 Bledsoe
4,690,195 A * 9/1987 Taylor
5,458,412 A * 10/1995 Lee et al.
5,522,190 A * 6/1996 Fullwood
5,577,820 A * 11/1996 Kim et al.
6,241,300 B1 * 6/2001 Suzuki

* cited by examiner

*Primary Examiner*—Blair M. Johnson
(74) *Attorney, Agent, or Firm*—Woodling, Krost and Rust

(57) ABSTRACT

A manual drive system for operating a protective covering for a building opening is disclosed and claimed. An access panel is also disclosed and claimed. The protective covering can be on the interior side or the exterior side of the building. An access panel can be located on the interior wall of the building near the opening or it can be located on the exterior wall of the building near the opening. The opening can be a window, bay, door or stall. The protective covering may be a windlocking curtain used in hurricanes. A guide having a retractable extension arm is mounted within the wall of the building. The retractable extension arm is pivotally attached to the access panel with a hinge. A first spring is operable between the guide and the retractable extension arm and a second spring is operable between the retractable extension arm and the access panel. A pulley and a pulley engaging device for operating the protective covering reside within the wall of the building. The access panel is retractably and rotatably moveable between a first position adjacent the wall of the building and a second position spaced away from the building under the influence of an external force such as the hand of a person thus enabling access to the pulley engaging device so as to operate the pulley and the protective covering. A method of operating the curtain which protects the building is also disclosed and claimed.

16 Claims, 12 Drawing Sheets

ACCESS PANEL FOR OPERATING AN IN-WALL CURTAIN DRIVE SYSTEM AND METHOD OF USING SAME

FIELD OF THE INVENTION

This invention is in the field of operating a windlocking curtain to prevent the intrusion of unwanted air, fluid (water and/or seawater) and debris during hurricanes and other high wind velocity storms. An access panel is provided for manual operation of an in-wall curtain drive system.

BACKGROUND OF THE INVENTION

In the event electric power is lost, electrically motorized curtain drive systems will not function. A manually powered and operated curtain drive system does not depend on the availability of electric power and will always function to protect the window, door, stall, bay or other opening from the intrusion of air, water or debris. During hurricanes and other high wind velocity storms, the breach of a building opening can cause great damage to the structure. If the building structure is not breached and remains relatively sealed, then substantial damage can be prevented.

SUMMARY OF THE INVENTION

The instant invention provides, among other things, for an access panel which can be retracted and rotated out of the way so that a person can reach inside a wall and operate a pulley cord and pulley. The manual drive system for operating a protective covering for a window, door, or other building opening includes a guide residing in a wall of the building. The guide is fixed to the building and resides within the wall. A sliding, retractable extension arm is movable back and forth within the guide. A first spring is operable between the guide and the retractable extension arm. An access panel is pivotally attached to the sliding, retractable extension arm. A pulley drives the protective covering for the opening and, specifically, a pulley engaging device drives the pulley.

The access panel is retractably and rotatably movable from a first position adjacent the wall of the building to a second position spaced away from the building. Under the influence of an external force (such as the hand of a person) the access panel is retracted thus enabling access to the pulley engaging device within the wall so as to operate the pulley and the protective covering. The pulley engaging device is typically a cord or a chain. Equivalents to a cord or a chain may be used. When the access panel is in its second position, the retractable extension arm extends beyond the wall of the building.

A second spring is operable between the retractable extension arm and the hinge for insuring rotatable closure of the access panel. The access panel further includes a stud affixed thereto and the building further includes a clasp affixed thereto. Upon rotatable closure of the access panel, and upon translational closure of the panel, the stud engages the clasp and it is therefore assured that the access panel will remain snugly against the wall.

The access panel is typically wood trim surrounding an opening in a building. Sometimes this wood trim is referred to as molding. The access panel may reside either on an interior wall of the building or it may reside on an exterior wall of the building. The use of the first and second spring in combination with the clasp and stud arrangement insures that the access panel may be made of a section of the wood trim or molding surrounding the interior opening of a building. The clasp and stud also ensure that the section of wood trim which covers the access opening fits well with respect to the remainder of the wood trim thereby providing an aesthetically pleasing appearance. In other words, it is an object of the invention to have an obscure access panel.

The access panel may be secured to the wall through use of the stud and clasp alone. In this embodiment, the access panel is removed from the wall and temporarily set aside while the pulley cord or chain is operated. Alternatively, another embodiment employs just the guide, extension arm and springs to allow operation of the pulley cord and securement of the access panel to the wall.

A method of operating the curtain which protects the building opening is also disclosed. The method utilizes a guide secured within a wall of the building. The guide includes a retractable extension arm slidable within the guide and movable with respect to the guide. A first spring is operable between the guide and the extension arm. An access panel covers an opening in a portion of the wall of a building. A hinge having a rotatable post is used with the hinge affixed to the retractable extension arm and the rotatable post affixed to the access panel. A second spring is utilized in the method and is operable between the retractable extension arm and a bracket which extends from the rotatable post affixed to the access panel. A pulley is also utilized A pulley is also utilized in the method for driving the curtain and a pulley engaging device such as a rope or a chain operates the pulley. The steps of the process include grasping the access panel by hand; moving the access panel away from the wall; retracting the retractable extension arm with respect to the guide; rotating the access panel and the rotatable post with respect to the wall; grasping the pulley engaging device by hand; pulling downwardly on the pulley engaging device and rotating the pulley; and, thus, operating the curtain. The method of operating the curtain is equally applicable to access panels residing on the interior of the building structure or on the exterior of the building structure.

It is an object of the present invention to provide a retractable access panel which enables access to a pulley for operation of a curtain.

It is an object of the invention to provide a hidden access panel which is aesthetically pleasing and which matches the ordinary interior or exterior building appearance.

It is an object of the invention to provide a hidden access panel which is affixed to a retractable extension arm of a guide, with the guide being affixed directly or indirectly to the frame of the building.

It is an object of the invention to provide a first spring operable between a guide and a retractable extension arm of the guide. It is a further object of the invention to provide a second spring operable between the retractable extension arm and a bracket, the bracket being part of the post.

It is an object of the invention to provide an opening in an interior wall or an exterior wall which, coupled with a retractable access panel, enables operation of an in-wall pulley system for driving a curtain between open and closed positions.

Other objects of the invention will become apparent when reference is made to the Brief Description of the Drawings, Description of the Invention and Claims which follow hereinbelow.

BRIEF DESCRIPTION OF THE DRAWINGS

FIG. 8 illustrates only the stud and the clasp for securing the section of trim.

FIG. 9 illustrates only the guide, extension arm and springs for securing the section of trim and for allowing operation of the pulley cord.

Figure 1:
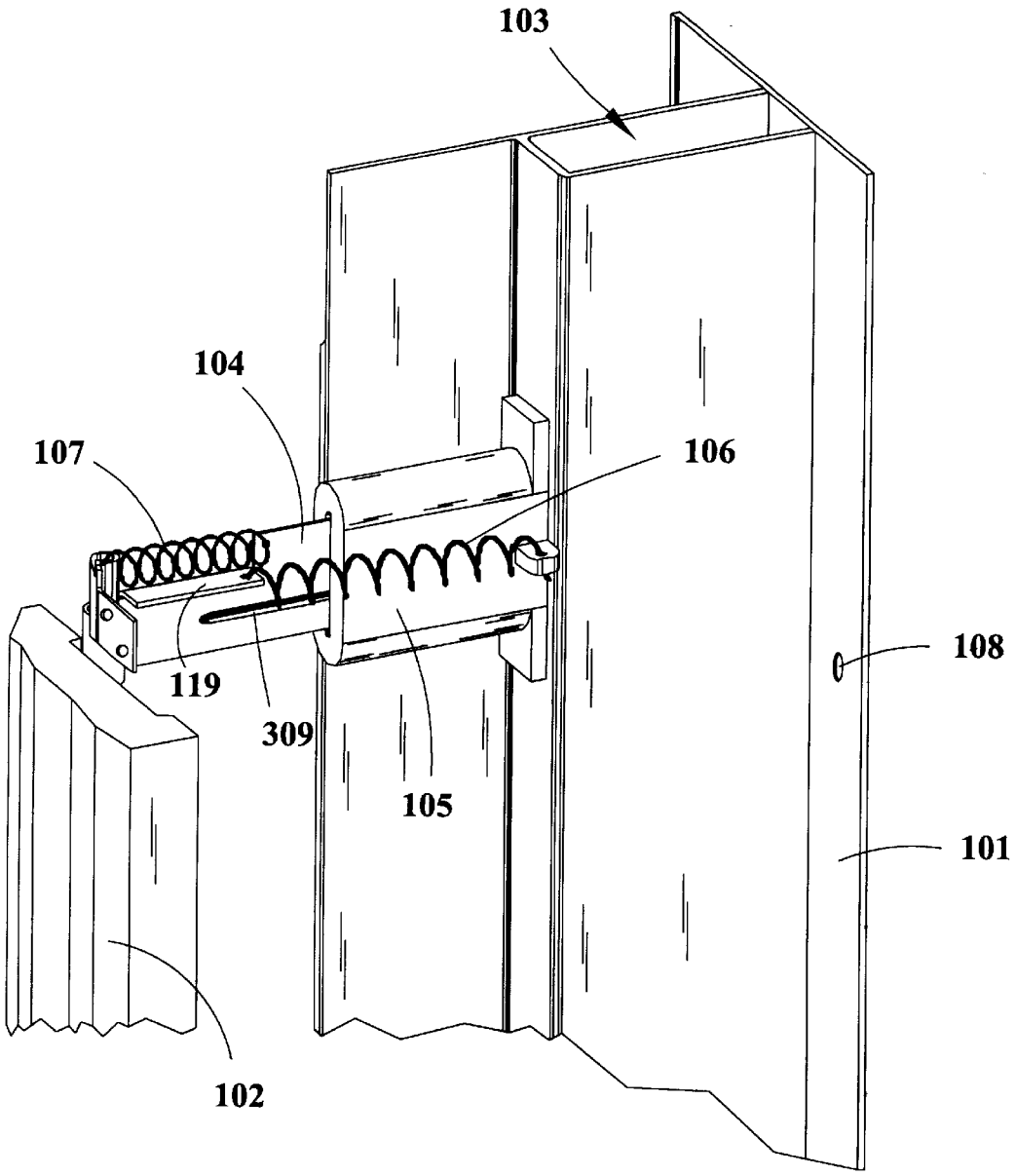
FIG. 1 is a front perspective view of the guide affixed to the frame, the retractable extension arm, hinge and a section of the wood trim.

A better understanding of the drawing figures will be had when reference is made to the Description of the Invention and the Claims which follow hereinbelow.

DESCRIPTION OF THE INVENTION

FIG. 1 is a front perspective of a portion of the invention. The trim or molding 102, the guide 105, the sliding retractable extension arm 104, and the frame 101 are shown in FIG. 1. A first spring 106 is operable between the guide 105 which is affixed to the frame 101 and the retractable extension arm 104. Second spring 107 is operable between the retractable extension arm 104, and the hinge.

Figure 5:
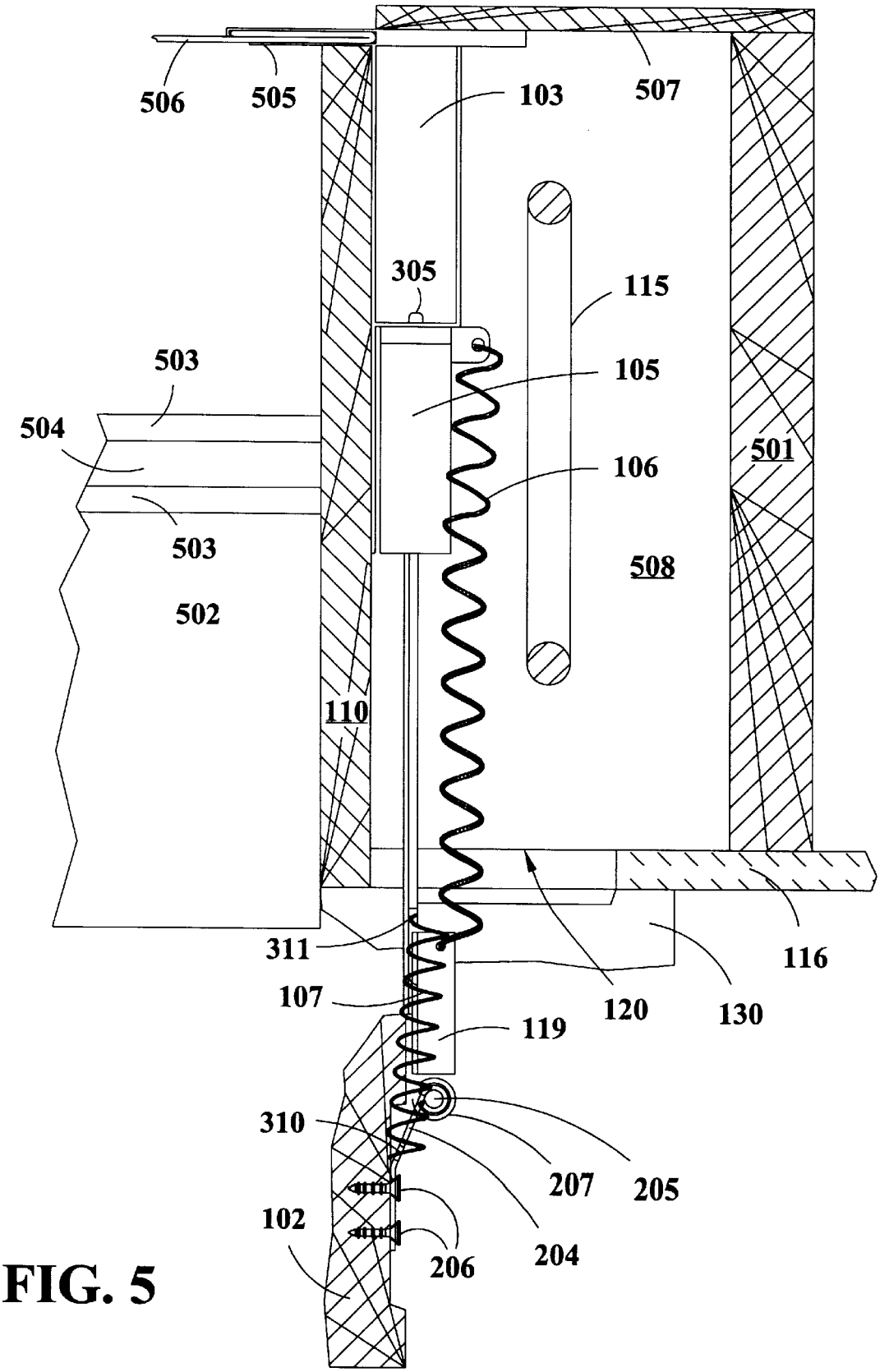
FIG. 5 is a top view shown partially in cross-section illustrating the wall, the retractable extension arm in its second position, the trim rotated to its open position about the hinge, and the pulley rope.

Retractable extension arm 104 is long enough that it extends, when viewing FIG. 1, into chamber 103 within the frame 101. See, FIG. 2 which illustrates the extension arm 104 extending through guide 105. Also illustrated in FIG. 1 is a slot 309 which assists in guiding the extension arm 104 within the guide 105. Further, FIG. 1 illustrates shelf 119 on the extension arm 104. Shelf 119 serves as a point of attachment for the first spring 106. First spring 106 is operable between the guide 105 and the shelf 119. Bolt hole 108 is one of a plurality of bolt holes. Frame 101 is connected to an external wall 507 as shown in FIG. 5 with bolts, nails or some other connectors.

Figure 1A:
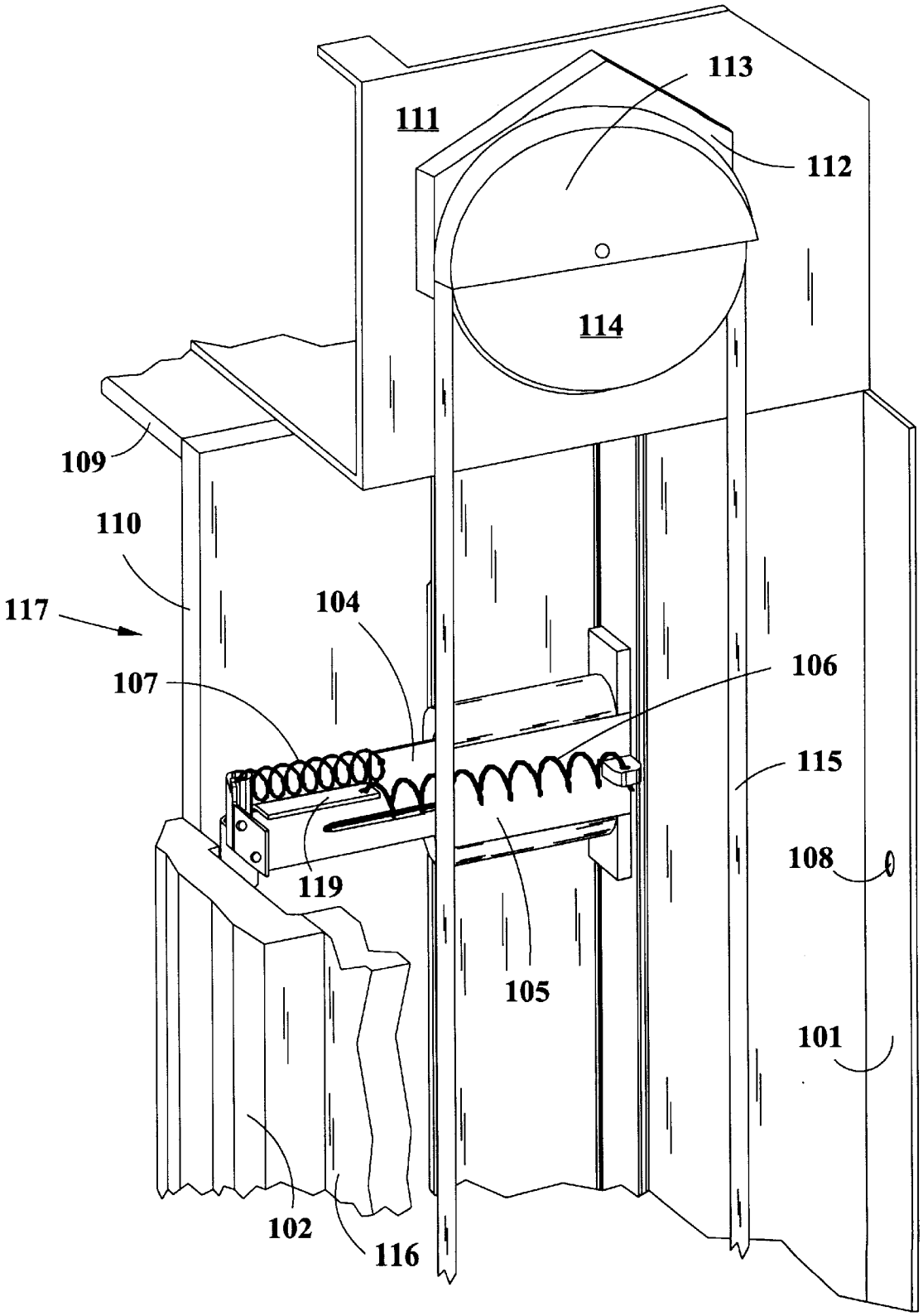
FIG. 1A is a front perspective view similar to that of FIG. 1 further illustrating the window frame, interior wall, pulley and rope.

FIG. 1A is a front perspective view similar to that of FIG. 1 further illustrating the window frame 110, the interior wall 116, the pulley 114, and the rope 115 which drives the pulley. Window jamb 109 is part of the window frame as is window side jamb 110. Reference numeral 117 points toward the location of the window which is not visible in this illustration. The structure would be the same if this were a door, a bay for unloading and loading trucks, a bay for the servicing of cars or other building openings. Frame 111 for the drive mechanism is indicated in FIG. 1A as is spacer plate 112 and pulley housing 113. The pulley cord 115 is, of course, continuous. Spacer plate 112 insures that pulley cord 115 does not interfere with guide 105 or first opening 106.

Figure 1B:
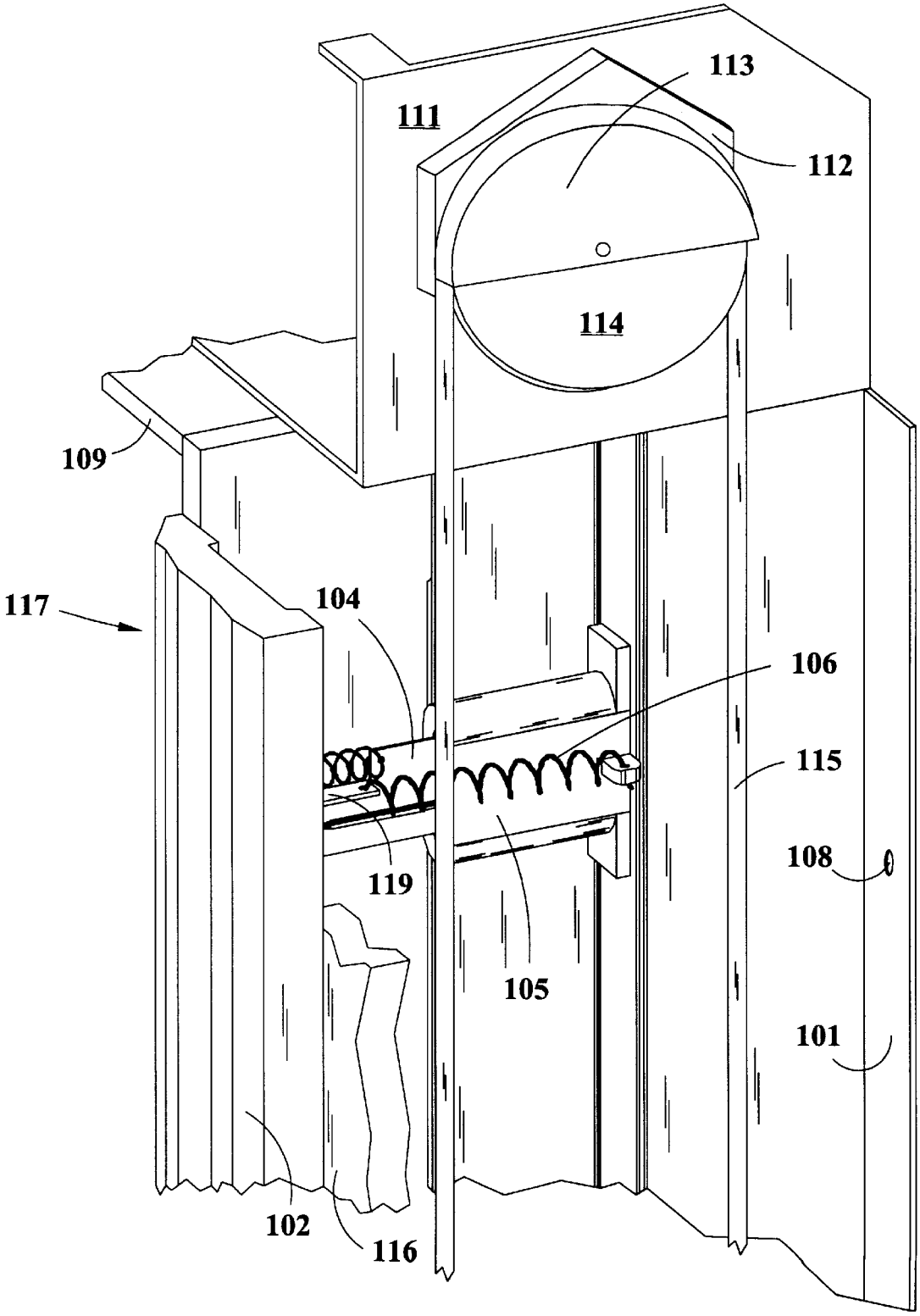
FIG. 1B is a front perspective view similar to that of FIG. 1A illustrating a section of trim in its first position adjacent the wall.

Referring to FIGS. 1A and 1B, it will be noticed that the access panel 102, which in this case is wood trim, abuts the side jamb 110 and the dry wall/interior wall 116. In this way access panel 102 hides an opening 120 which exists between the interior wall 116 and the window side jamb 110. See, FIG. 5. When the access panel 102 is retracted, a person grasps the pulley cord 115 and pulls it either downwardly or slightly downwardly and outwardly to rotate pulley 114. It is pulley 114 that drives curtain drive 208.

FIG. 1B is a front perspective view similar to that of FIG. 1A illustrating a section of window trim 102 in its first position adjacent the wall 116. It will be noticed that an entire section of wood trim 102 is indicated in FIG. 1B whereas in FIGS. 1 and 1A only a portion of a section of wood trim 102 is indicated. Typically, the section of wood trim 102 will be on the order of 6 to 8 inches long. Other users may prefer a longer section of wood trim 102, perhaps 12 to 18 inches. Certain users of the manual drive system where a particularly large curtain is used may necessitate a large access panel 102 and a large opening 120.

Figure 1C:
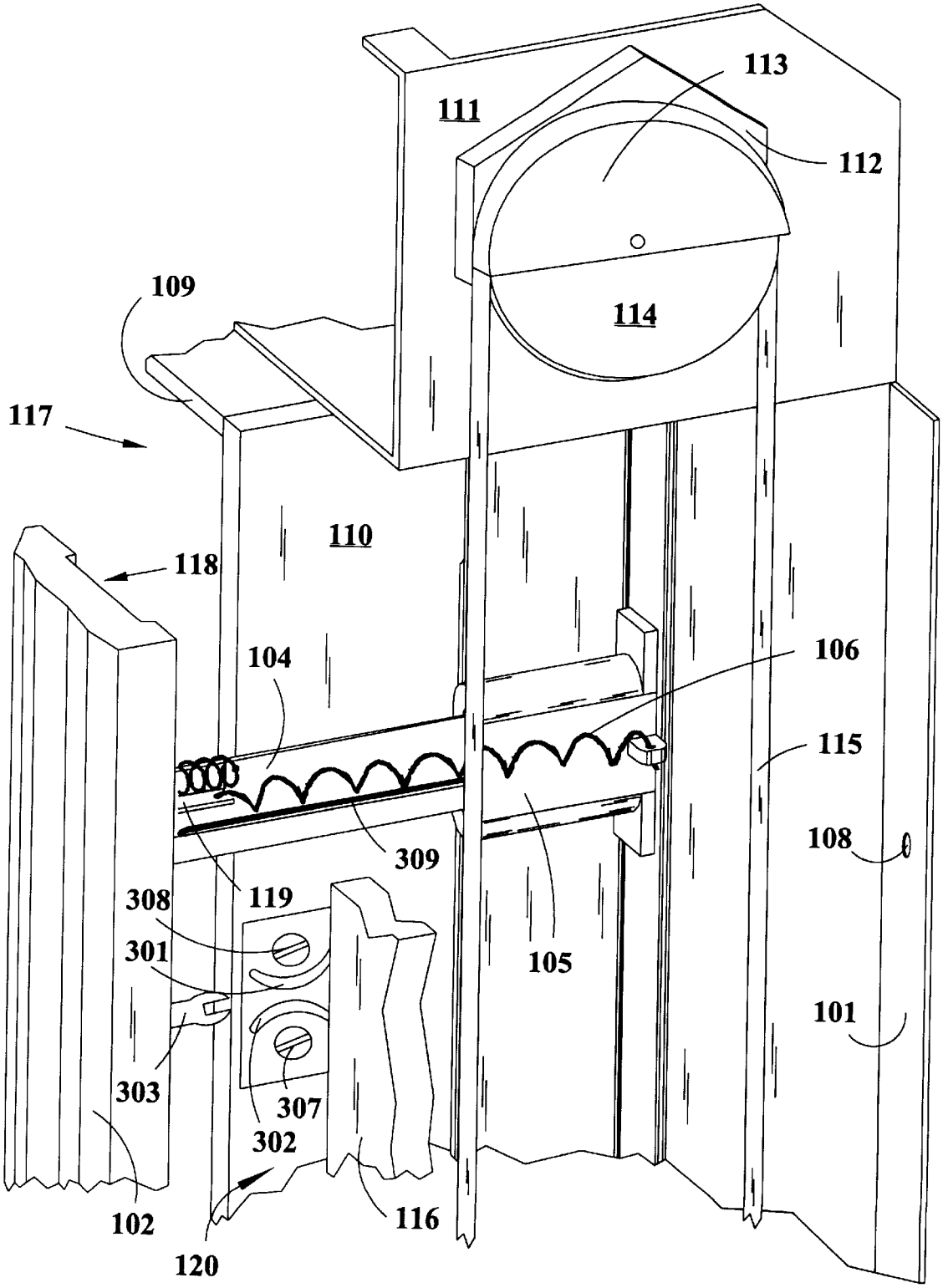
FIG. 1C is a front perspective view illustrating a section of trim in its second position spaced away from the wall.

FIG. 1C is a front perspective view illustrating a section of wood trim 102 in its second position spaced away from the wall 116 and the window side jamb 110. In the second position, the wood trim 102 has been translationally moved along with arm 102 perpendicularly away from the wall. Reference numeral 118 indicates the retraction of molding 102 away from the wall 116 and the side jamb 110. Reference numeral 120 is an arrow pointing to the opening between the dry wall 116 and the side jamb 110. FIG. 1C also illustrates clasps 301 and 302 which are mounted on to the side jamb 110 of the window frame by screws 307 and 308. Clasps 301 and 302 are best viewed in FIG. 2. Stud 303, which is affixed to trim 102, interengages with clasps 301 and 302 to secure the wood trim 102 to the window frame 110 and the dry wall 116 when the wood trim section 102 is in its first position adjacent the wall 116 and the side jamb 110. FIG. 1C represents the retraction of the wood trim section 102 which results in the uncovering of the opening 120; however, it does not illustrate the rotation of the wood trim 102 about its hinge. FIG. 1C illustrates the second position of the wood trim 102. The second position of the wood trim 102 can be either that shown in FIG. 1C with the wood trim not being rotated or it can be as shown in FIG. 5 with the wood trim 102 being rotated. Further, the wood trim 102 is just one type or kind of access panel which may be used. For instance, industrial buildings may not employ wood trim and instead a metal panel may be used to cover the opening 120.

Figure 2:
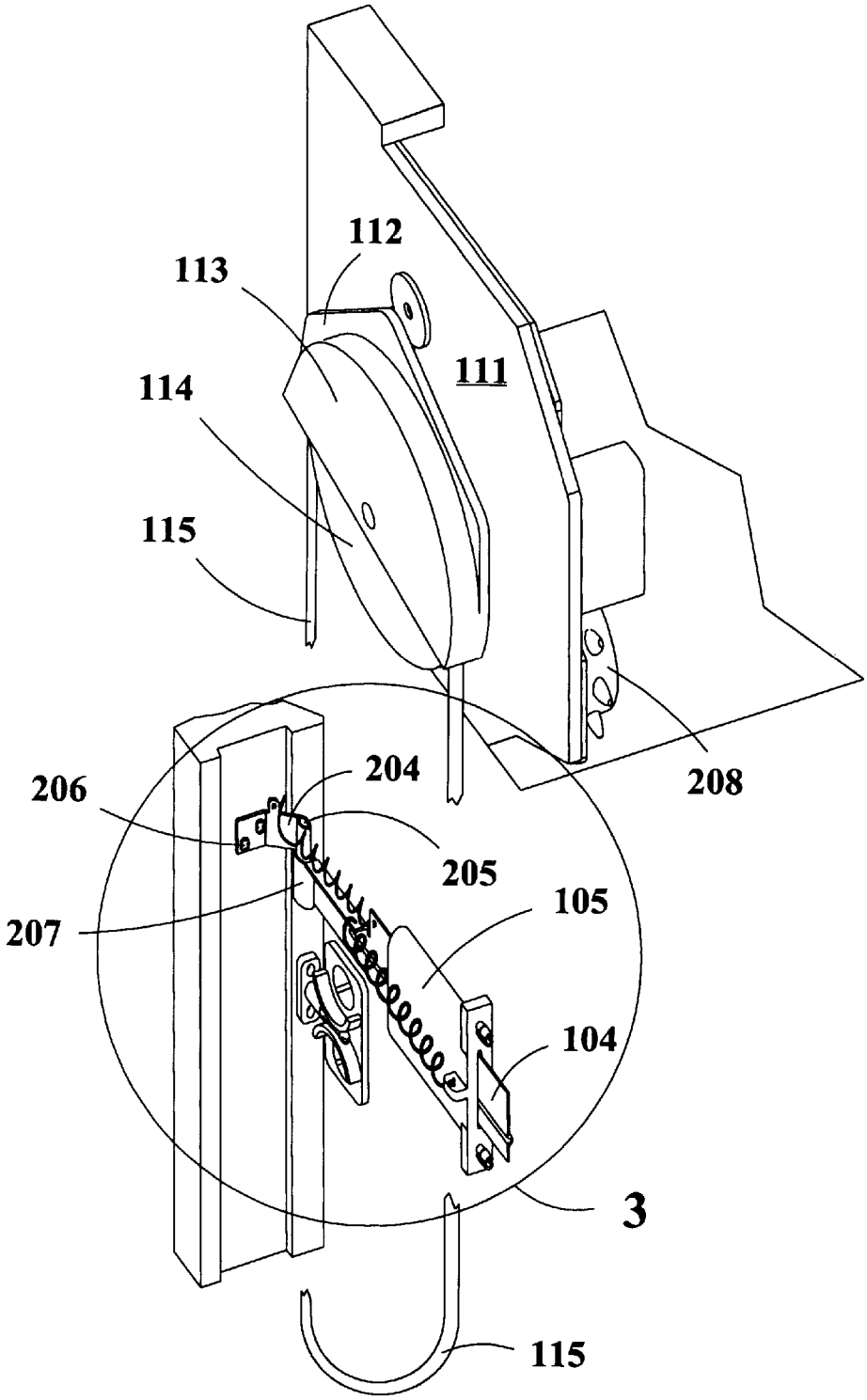
FIG. 2 is a rear perspective view illustrating a section of trim affixed to the retractable extension arm.

FIG. 2 is a rear perspective view illustrating a section of trim 102 affixed to the retractable extension arm 104. Hinge 207 is illustrated in FIG. 2. A rotatable post 205 is illustrated as fitting down within hinge 207. Hinge 207 is part of retractable extension arm 104. Post 205 is part of a bracket 204 which is secured to the wood trim by screws 206. Reference numeral 208 indicates the curtain drive mechanism. Wood trim 202 (or other access panel) is rotatable with respect to wall 116 and side wood jamb 110. The angle of rotation of the access panel may be up to 90 degrees. See FIG. 5.

Figure 3:
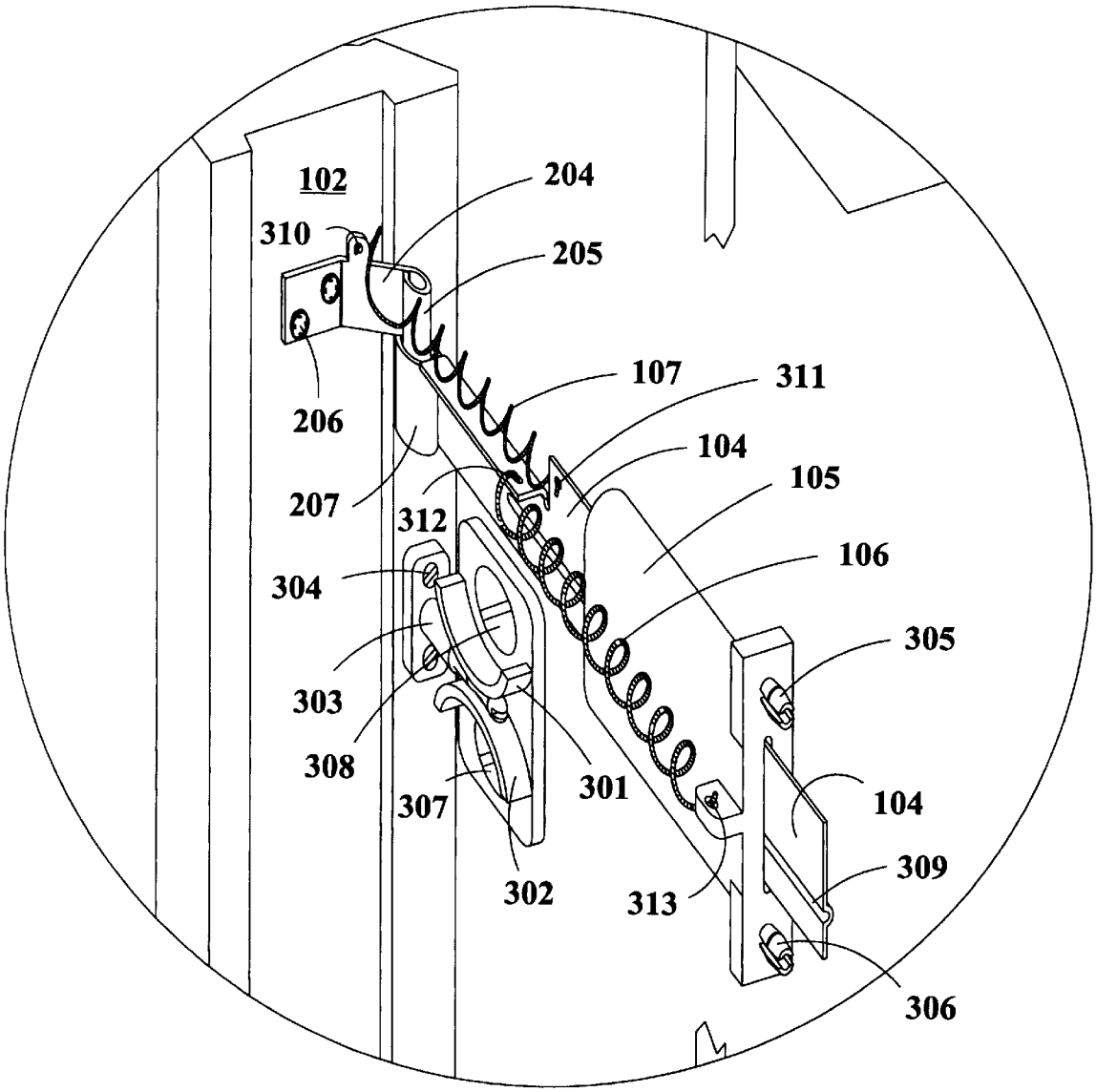
FIG. 3 is an enlarged portion of FIG. 2.

FIG. 3 is an enlarged portion of FIG. 2. FIG. 3 illustrates the attachment of stud 303 to the access panel 102 with screws 304. FIG. 3 also best illustrates the attachment of the second spring 107 to the bracket 204. The other end of spring 107 is hooked in aperture 310 of bracket 204. Spring 107 is hooked in aperture 311 of arm 104. Spring 107 is operable between the retractable extension arm 104 and the bracket 204. It is spring 107 which assists in the rotatable closure of the wood trim 102 as will be explained in more detail hereinbelow.

First spring 106 is hooked in aperture 311 of the retractable arm and is also hooked in aperture 313 by the guide 105. FIG. 3 also illustrates the groove 309 which exists in the retractable extension arm 104. Groove 309 in conjunction with a reciprocal mating protrusion within guide 305 helps stabilize the retraction of the wood trim 102. Screw attachments 305 and 306 are used to secure the guide 105 to the frame 101.

Figure 4:
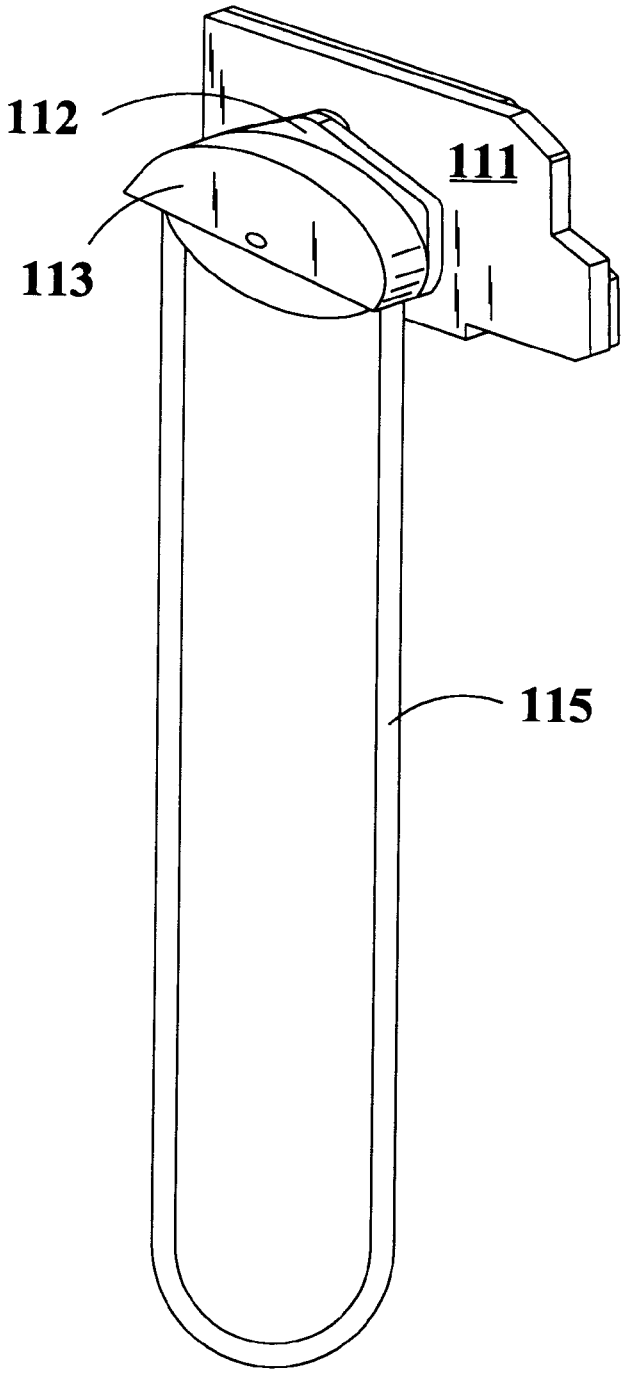
FIG. 4 is a rear perspective view of the pulley.

FIG. 4 is a rear perspective of the pulley 114 and the continuous pulley cord 115. Pulley cord 115 may be different lengths depending on the curtain to be operated.

FIG. 5 is a top view shown partially in cross section illustrating the wall 116, the retractable extension arm 104 in its second position, the trim 102 rotated to its open position about the hinge 207, the pulley rope 115, and the side jamb of the window 110 among other things. Reference numeral 502 indicates the window sill. The window's sash is indicated by reference numeral 103 and the window 104 is also best viewed here. FIG. 5 provides a relative positioning of the window 504 with respect to the window frame 110, sill 502, curtain 506, curtain guide 505, opening 120 between wall 116 and side jamb 110, pulley cord 115, guide 105, springs 106 and 107, and wood trim 102. Wood stud 501 is illustrated as extending between the interior dry wall 116 and the exterior outer wall or plywood 507. The hurricane curtain 506 is illustrated partially within the channel/guide for the curtain 505.

Opening 120 is the space whereby a person's hand is able to fit into the wall as defined by reference numeral 508. Opening 120 may be larger or smaller as required or desired. The operator may pull down on the cord 115 while it is within the wall or he/she may slightly pull the cord toward the interior wall 116 and then pull down. He/she may also preferentially pull the cord outside of the dry wall and operate the curtain. Alternatively, the access panel and other structure could be oriented with respect to the exterior wall 507. The in-wall drive system could then be operated from the exterior of the building.

FIG. 5 illustrates the wood trim 102 in its second position. Spring 107 has been elongated by the rotation of the wood trim 102 ninety degrees with respect to wall 116. Reference numeral 510 illustrates the rotational direction of the access panel 102. Spring 106 in FIG. 5 is also illustrated in an elongated condition as the arm 104 has been partially withdrawn from the guide 105.

The method of operating the drive system is as follows. A person grasps the access panel with one of his/her hands. Next, the person pulls the access panel 102 away from the wall 116 and the wood jamb 110 against the force of spring 106 and the force of clasps 301 and 302. When the access panel 102 is pulled away from the wall, the retractable extension arm 104 is pulled along with it because the panel is affixed to the arm through hinge 207, post 205 and bracket 204. Then, the access panel may be rotated (against the force of spring 107) up to and through ninety degrees as illustrated by reference numeral 510. Then, the person uses his or her other hand to grasp the portion of the pulley cord or chain 115 nearest to him/her and pulls down on it.

Alternatively, the cord 115 can be pulled exteriorly from the interior of the wall 508 and operated from the interior side of wall 116. In this way, the range of motion in pulling the cord 115 will be increased. When the curtain has been raised or lowered as desired, the person then lets the trim 102 and the extension arm 104 move back toward the wall 106 under the force of spring 106.

Spring 107 rotatably closes the trim to seat on wood jamb 110 and wall 116 as the person permits movement toward the wall and jamb. Stud 303 is then forcibly urged, by the person, into engagement with clasp 301 and 302.

Figure 6:
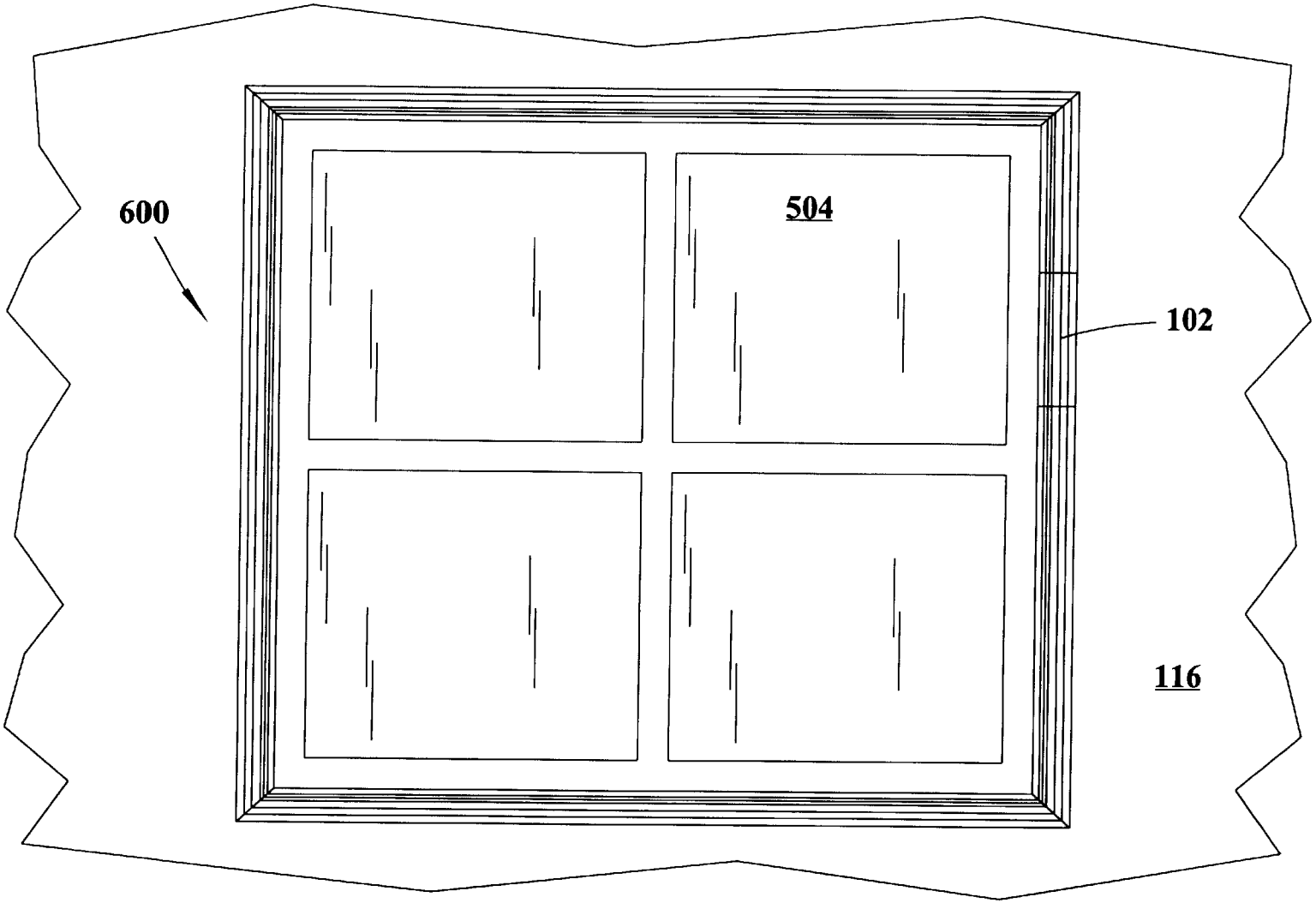
FIG. 6 is a view of a window showing a section of the trim which may be retracted.

FIG. 6 illustrates an interior view 600 of a window 504. Trim section 102 is illustrated. It will be understood by those skilled in the art upon reading the disclosure that trim section 102 could be located on either side of the window, left or right, and it could be positioned higher or lower than is shown.

Figure 7:
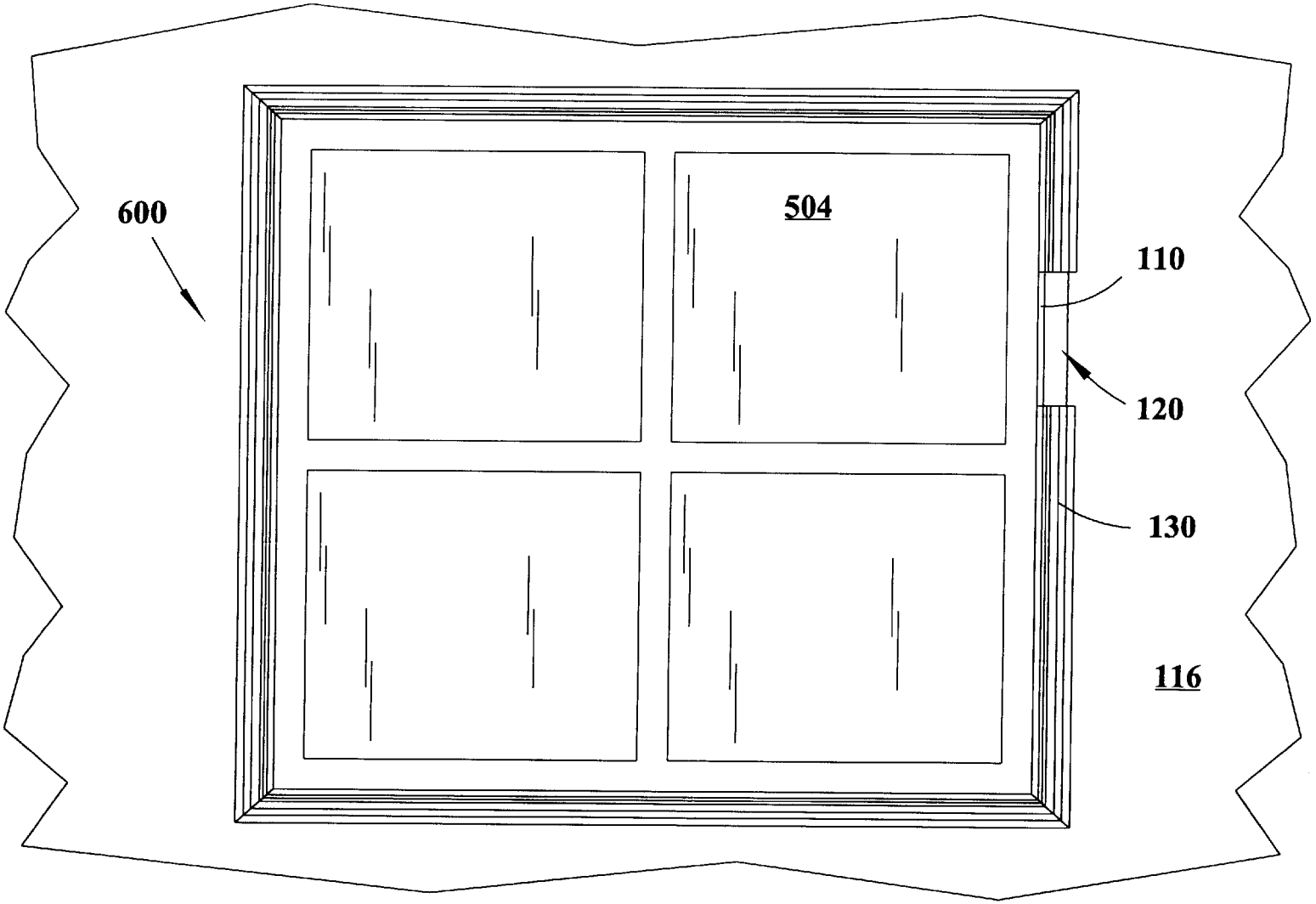
FIG. 7 illustrates a window with the section of trim removed so as to enable a view of the opening.

FIG. 7 illustrates a window with the section of trim 102 removed so as to enable a view of opening 120. Opening 120 may be of a size as chosen by the user with a correspondingly sized access panel used therewith. Opening 120 is covered by trim 102 as indicated in FIG. 1B. Wood trim 130 resides below opening 120 as illustrated in FIGS. 5 and 7.

Figure 8:
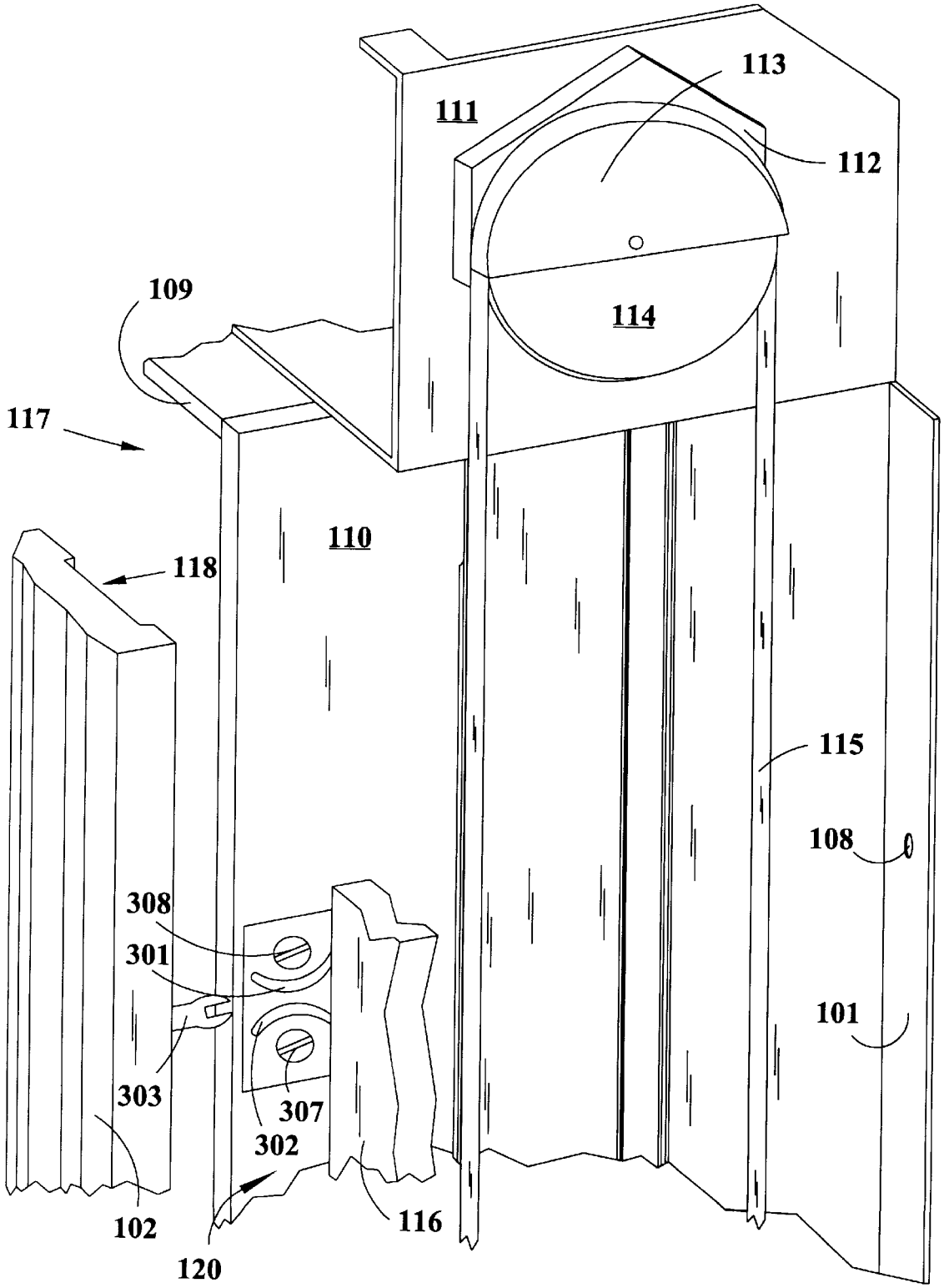
FIG. 8 is a front perspective view of another embodiment illustrating a section of trim in its second position spaced away from the wall.

FIG. 8 is a front perspective view of another embodiment illustrating a section of trim 102 in the second position spaced away from the wall. Reference numeral 118 indicates the trim 102 retracted from the wall 116. In this embodiment, only the stud 303 and the clasp 301/302 secure the trim 102 to the wall and the jamb 110. When the trim 102 is removed it can be set aside or held by the person operating pulley cord 115.

Figure 9:
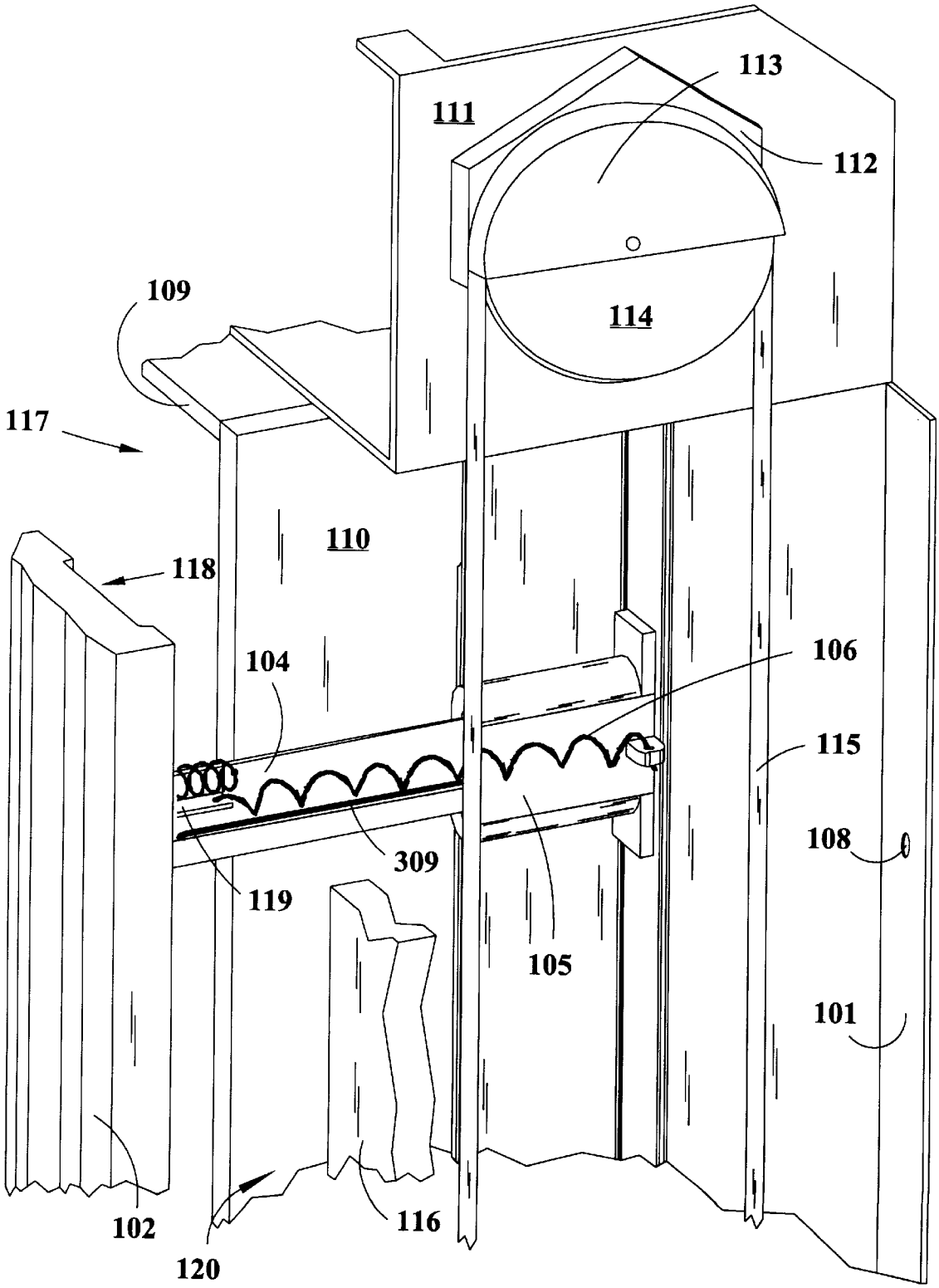
FIG. 9 is a front perspective view of another embodiment illustrating a section of trim spaced way from the wall.

FIG. 9 is a front perspective view of another embodiment illustrating a section of trim 102 spaced away from the wall 116. The embodiment of FIG. 9 illustrates only the guide, extension arm and springs for securing trim 102 and for allowing operation of the pulley end 115. As illustrated in FIG. 3, for example, the stud and clasps may be used in conjunction with the guide, extension arm and springs if so desired.

Further, those skilled in the art will understand that many changes and modifications may be made to the invention as disclosed herein without departing from the spirit and scope of the appended claims.

We claim:

1. A manual drive system for operating a protective covering for a window, door or other building opening, comprising:

a guide residing in a wall of said building and being affixed to said building;

said guide includes a sliding, retractable extension arm;

a spring operable between said guide and said retractable extension arm;

an access panel in a wall of said building;

said sliding, retractable extension arm being pivotally attached to said access panel;

a pulley and a pulley engaging device for operating said protective covering residing within a wall of the building;

said access panel being retractably and rotatably moveable from a first position adjacent said wall of said building to a second position spaced away from said building under the influence of an external force such as a hand of a person thus enabling access to said pulley engaging device so as to operate said pulley and said protective covering.

2. A manual drive system as claimed in claim 1 wherein said pulley engaging device is selected from the group of a cord or a chain.

3. A manual drive system as claimed in claim 1 further comprising a second spring operable between said extension arm and said hinge for ensuring rotatable closure of said access panel.

4. A manual drive system as claimed in claim 3 further comprising a clasp affixed to said building and a stud affixed to said access panel.

5. An access panel in a building, comprising:

a section of trim surrounding an opening in a building;

a guide affixed to a wall and residing within said wall of said building;

said guide includes a retractable extension arm; and, said trim affixed to said retractable extension arm of said guide and being moveable between a first, closed position and a second, open position spaced apart from said wall.

6. An access panel as claimed in claim 5 further comprising:

a first spring;

said guide including a retractable extension arm; and, said first spring operable between said guide and said retractable extension arm.

7. An access panel as claimed in claim 6 further comprising:

a hinge affixed to said retractable extension arm;

a rotatable post within said hinge affixed to said trim; and, a second spring operable between said retractable extension arm and said rotatable post urging said trim toward said wall when said trim is in its first, closed position.

8. An access panel as claimed in claim 7 further comprising:

a stud affixed to said trim and a clasp affixed to said wall for securing said trim to said wall for securing said trim to said wall when said trim is in a first, closed position.

9. A method of operating a curtain which protects a building opening such as a window, door, bay, or stall utilizing a guide secured within a wall of said building, said guide having a retractable extension arm slidable within said guide and movable with respect to said guide, a first spring operable between said guide and said extension arm, an access panel which covers a portion of a wall of said building, a hinge having a rotatable post, said hinge affixed to said retractable extension arm and said rotatable post affixed to said access panel, a second spring operable between said retractable extension arm and said rotatable post affixed to said access panel, a pulley for driving said curtain, and a pulley engaging device operable by a person, comprising the steps of:

grasping said access panel by hand;

moving said access panel away from said wall;

retracting said retractable extension arm with respect to said guide;

rotating said access panel and said rotatable post with respect to said wall;

grasping said pulley engaging device by hand;

pulling downwardly on said pulley engaging device and rotating said pulley; and, operating said curtain.

10. A method of operating a curtain as claimed in claim 9 wherein said access panel is a portion of the wood trim surrounding the window frame.

11. A method of operating a curtain as claimed in claim 10 wherein said wood trim is located on an interior wall.

12. A method of operating a curtain as claimed in claim 10 wherein said wood trim is located on an exterior wall.

13. A method of operating a curtain as claimed in claim 9 wherein said pulley engaging device is a rope.

14. A method of operating a curtain as claimed in claim 9 wherein said pulley engaging device is a chain.

15. A method of operating a curtain as claimed in claim 9 wherein said access panel includes a stud affixed thereto and wherein said wall includes a clasp affixed thereto for receiving said stud, further comprising the steps of:

securing said access panel to said wall by interengaging said stud with said clasp.

16. A method of operating a curtain which protects a building opening such as a window, door, bay, or stall utilizing a guide secured within a wall of said building, said guide having a retractable extension arm slidable within said guide and movable with respect to said guide, a first spring operable between said guide and said extension arm, an access panel which covers a portion of a wall of said building, a hinge having a rotatable post, said hinge affixed to said retractable extension arm and said rotatable post affixed to said access panel, a second spring operable between said retractable extension arm and said rotatable post affixed to said access panel, a pulley for driving said curtain, and a pulley engaging device operable by a person, comprising the steps of:

grasping said access panel by hand;

moving said access panel away from said wall;

retracting said retractable extension arm with respect to said guide;

rotating said access panel and said rotatable post with respect to said wall; and, grasping said pulley engaging device by hand.

* * * * *

UNITED STATES PATENT AND TRADEMARK OFFICE

CERTIFICATE OF CORRECTION

PATENT NO. : 6,378,593 B1
DATED : April 30, 2002
INVENTOR(S) : Mullet et al.

It is certified that error appears in the above-identified patent and that said Letters Patent is hereby corrected as shown below:

Column 2,
Lines 25-26, delete "A pulley is also utilized"

Column 7,
Line 38, delete "for securing said trim to said wall"

Signed and Sealed this

Twenty-second Day of October, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,378,593 B1
DATED : April 30, 2002
INVENTOR(S) : Mullet et al.

It is certified that error appears in the above-identified patent and that said Letters Patent is hereby corrected as shown below:

Column 2,
Lines 25-26, delete "A pulley is also utilized"

Column 7,
Line 38, delete "for securing said trim to said wall"

Signed and Sealed this

Twenty-ninth Day of October, 2002

*Attest:*

*Attesting Officer*

JAMES E. ROGAN
*Director of the United States Patent and Trademark Office*